US011667361B2

(12) United States Patent
Bamba

(10) Patent No.: US 11,667,361 B2
(45) Date of Patent: Jun. 6, 2023

(54) VESSEL PROPULSION SYSTEM, DEVICE, AND METHOD TO DIAGNOSE THE VESSEL PROPULSION SYSTEM

(71) Applicant: YAMAHA HATSUDOKI KABUSHIKI KAISHA, Iwata (JP)

(72) Inventor: Takaaki Bamba, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 335 days.

(21) Appl. No.: 16/856,570

(22) Filed: Apr. 23, 2020

(65) Prior Publication Data

US 2020/0339236 A1 Oct. 29, 2020

(30) Foreign Application Priority Data

Apr. 24, 2019 (JP) ..... JP2019-083162

(51) Int. Cl.
*B63B 79/40* (2020.01)
*B63H 25/02* (2006.01)

(52) U.S. Cl.
CPC ..... *B63B 79/40* (2020.01); *B63H 25/02* (2013.01)

(58) Field of Classification Search
CPC ..... B63B 79/40; B63H 25/02
USPC ..... 701/21
See application file for complete search history.

(56) References Cited

U.S. PATENT DOCUMENTS 7,353,095 B2 * 4/2008 Kanno ..... G05B 23/0235 701/32.7
9,702,785 B2 * 7/2017 Fujino ..... G01M 15/05
2004/0242091 A1 * 12/2004 Okuyama ..... B63H 21/21 440/86
2005/0010339 A1 * 1/2005 Matsuda ..... B63B 49/00 701/21
2005/0245145 A1 11/2005 Takada et al.
2008/0171480 A1 7/2008 Kado et al.
2008/0214069 A1 9/2008 Kawanishi et al.
2014/0106632 A1 4/2014 Nakayasu
2019/0193654 A1 * 6/2019 Ohno ..... G07C 7/00

FOREIGN PATENT DOCUMENTS

JP 2002-160694 A 6/2002
JP 2005-315219 A 11/2005
JP 2008-163864 A 7/2008
JP 2008-202517 A 9/2008
(Continued)

OTHER PUBLICATIONS

Official Communication issued in corresponding Japanese Patent Application No. 2019-083162 dated Nov. 10, 2022.
(Continued)

*Primary Examiner* — Peter D Nolan
*Assistant Examiner* — Luke Huynh
(74) *Attorney, Agent, or Firm* — Keating and Bennett, LLP

(57) ABSTRACT

A vessel propulsion system includes an on-board network, a plurality of propulsion apparatuses provided on a hull and connected to the on-board network, and a network connector to connect a diagnosis device to the on-board network. Each of the propulsion apparatuses includes a controller configured or programmed to transmit operating state information showing an operating state of the respective propulsion apparatus to the diagnosis device via the network connector.

10 Claims, 8 Drawing Sheets

(56) References Cited

FOREIGN PATENT DOCUMENTS

| | | | |
|---|---|---|---|
| JP | 2014-080083 | A | 5/2014 |
| JP | 2014-184845 | A | 10/2014 |

OTHER PUBLICATIONS

Kitagawa et al., "Development of Electronic Unit Pump for Medium Speed Diesel Engines", Journal of the Japan Institute of Marine Engineering, vol. 45, Issue 4, 2010, 5 pages.
Sasada et al., "Extraction Method of Fault Component on Acoustic Signals Generated by an Outboard Marine Engine Based on Characteristic of Paralleled Auto Regressive Model with Extra Input", Proceedings of the Symposium on Evaluation and Diagnosis of the Japan Society of Mechanical Engineers, 2010, pp. 29-32.
Shinkuma, 'Yanmar "Smart Assist-Remote" System', Journal of the Japanese Society of Agricultural Machinery and Food Engineers, vol. 76, Issue 4, 2014, pp. 295-299.
Second Office Action in JP2019-083162, dated Mar. 9, 2023, 3 pages.
Yamaha Motor Co., Ltd., "Outboard Motors," Yamaha Diagnostic System Version 2.00 Instruction Manual, 1st Edition, Aug. 2011, 139 pages.

* cited by examiner

VESSEL PROPULSION SYSTEM, DEVICE, AND METHOD TO DIAGNOSE THE VESSEL PROPULSION SYSTEM

CROSS REFERENCE TO RELATED APPLICATIONS

This application claims the benefit of priority to Japanese Patent Application No. 2019-083162 filed on Apr. 24, 2019. The entire contents of this application are hereby incorporated herein by reference.

BACKGROUND OF THE INVENTION

1. Field of the Invention

The present invention relates to a vessel propulsion system. The present invention further relates to a diagnosis device and a diagnosis method to diagnose the vessel propulsion system.

2. Description of the Related Art

US Patent application publication No. 2008/0214069 A1 discloses a vessel including a vessel propulsion apparatus and a remote control device. The vessel propulsion apparatus includes an engine and an engine control device. The remote control device includes an operating lever and a controller. The engine control device and the controller of the remote control device are connected to enable communication through a network, and a shifting device and a throttle operating device of the vessel propulsion apparatus are remotely operated by the operating lever.

The engine control device includes a nonvolatile memory that stores operating data input from sensors and switches equipped in the engine. A service tool (personal computer) can be connected to the engine control device through a connector. By connecting a service tool to the engine control device, a diagnosis operator can read out past operating data stored in the nonvolatile memory and display the operating data on a monitor screen, and diagnose the engine based on the displayed operating data.

SUMMARY OF THE INVENTION

The inventor of preferred embodiments of the present invention described and claimed in the present application conducted an extensive study and research regarding a vessel propulsion system, such as the one described above, and in doing so, discovered and first recognized new unique challenges and previously unrecognized possibilities for improvements as described in greater detail below.

In some cases, a plurality of propulsion apparatuses may be provided in a vessel. When diagnosing a plurality of propulsion apparatuses according to the prior art disclosed in US Patent application publication No. 2008/0214069 A1, each propulsion apparatus can be diagnosed by individually connecting a service tool to the control device of each propulsion apparatus.

However, there is a case in which a failure that cannot be found by such an individual diagnosis may occur. As an example, there is a case in which the plurality of propulsion apparatuses are controlled in synchronization and one of them fails. For example, in one propulsion apparatus, as a bearing partially binds or oil partially solidifies and a rotational resistance of a rotational shaft increases accordingly, acceleration response of this propulsion apparatus deteriorates. In such a case, due to the synchronization control, control devices of other propulsion apparatuses make their rotation speeds follow the rotation speed of the propulsion apparatus that has deteriorated in response. Therefore, the plurality of propulsion apparatuses exhibit the same behavior, so that it is difficult to identify the propulsion apparatus that has failed through the five physical senses of the user or diagnosis operator. It is possible for a user to recognize the above-described failure as a malfunction; however, the user finds it difficult to identify the malfunctioning propulsion apparatus. In addition, a failure does not always occur, and a failure may sometimes occur during use of the vessel. In such a case, it is more difficult to identify the malfunctioning propulsion apparatus.

Although a service tool can make a diagnosis based on information on individual propulsion apparatuses, a service tool is not suitable for finding a failure that can be identified by comparing operating state information of the plurality of propulsion apparatuses. For example, it may be possible that a plurality of service tools are respectively connected to control devices of a plurality of propulsion apparatuses, and operating state information of the plurality of propulsion apparatuses are logged. However, the recorded operating state logs conform to time axes unique to the respective service tools, and it is difficult to rigorously compare the operating state logs of the plurality of propulsion apparatuses. Therefore, it is difficult to identify the propulsion apparatus causing a failure that is able to be identified by using a slight temporal difference as a clue.

As a matter of course, a malfunctioning propulsion apparatus can be identified by removing all of the propulsion apparatuses from the vessel and undergoing an overhaul; however, this requires removal and overhaul of the propulsion apparatuses that have no failures, which wastes labor and time.

Another example of a failure difficult to find by an individual diagnosis is a case in which turning devices of a plurality of propulsion apparatuses are controlled in synchronization, and one of them fails. For example, when an abnormality in which a turning operation slows down occurs in a turning device of one of the propulsion apparatus, due to the synchronization control, turning operations of other propulsion apparatuses also exhibit the same behavior. Therefore, it is difficult to identify the malfunctioning propulsion apparatus that has failed through the five physical senses of the user or diagnosis operator. Therefore, the same situation as in the case described above occurs. An abnormality in which a turning operation slows down is caused by an abnormality of an actuator inside the turning device, or an abnormality in wiring, etc.

Besides these examples, for abnormalities that can be found by comparing the behaviors of the plurality of propulsion apparatuses in detail, a method to find the abnormalities has not conventionally been established.

Therefore, preferred embodiments of the present invention provide vessel propulsion systems that enable a diagnosis of a matter that is able to be identified by comparing operating state information of a plurality of propulsion apparatuses.

A preferred embodiment of the present invention further provides a diagnosis device and a diagnosis method to diagnose the above-described vessel propulsion system.

In order to overcome the previously unrecognized and unsolved challenges described above, a preferred embodiment of the present invention provides a vessel propulsion system including an on-board network, a plurality of propulsion apparatuses provided on a hull and connected to the on-board network, and a network connector to connect a diagnosis device to the on-board network. Each of the propulsion apparatuses includes a controller configured or programmed to transmit operating state information showing an operating state of the propulsion apparatus to the diagnosis device via the network connector.

With the above structure, the diagnosis device is able to be connected to the on-board network through the network connector. Therefore, the diagnosis device is able to communicate with the plurality of propulsion apparatuses through the on-board network. The controller of each propulsion apparatus transmits operating state information of the propulsion apparatus to the diagnosis device. Therefore, the diagnosis device is able to acquire operating state information of the plurality of propulsion apparatuses on a common time axis. Accordingly, the plurality of propulsion apparatuses are able to be diagnosed by comparing operating state information of the plurality of propulsion apparatuses on the common time axis.

In a preferred embodiment of the present invention, each of the propulsion apparatuses includes a prime mover and a propulsion member that generates a thrust by being driven by the prime mover, and operating state information to be transmitted by the controller includes rotation speed information showing a rotation speed of the prime mover.

With this structure, the diagnosis device is able to acquire rotation speed information showing rotation speeds of the prime movers on a common time axis from the plurality of propulsion apparatuses. Accordingly, the plurality of propulsion apparatuses are able to be diagnosed by comparing prime mover rotation speeds of the plurality of propulsion apparatuses on the common time axis.

In a preferred embodiment of the present invention, the controllers of the respective propulsion apparatuses are configured or programmed to synchronize the plurality of prime movers provided in the plurality of propulsion apparatuses.

With this structure, since the plurality of prime movers are controlled in synchronization, the prime mover rotation speed of each propulsion apparatus follows prime mover rotation speeds of other propulsion apparatuses. Therefore, the prime mover rotation speeds of the plurality of propulsion apparatuses temporally change in the same way, so that even when there is a propulsion apparatus having a prime mover rotation speed that behaves differently from prime mover rotation speeds of other propulsion apparatuses, it is difficult to identify this propulsion apparatus by conventional techniques. Therefore, by acquiring prime mover rotation speeds of the plurality of propulsion apparatuses on a common time axis through the on-board network and comparing the acquired speeds by the diagnosis device, a propulsion apparatus that behaves differently is easily identified.

In a preferred embodiment of the present invention, the vessel propulsion system includes a turning angle command value generator that generates turning angle command values for the plurality of propulsion apparatuses, and wiring that transmits turning angle command values generated by the turning angle command value generator to the controllers of the plurality of propulsion apparatuses. Each of the propulsion apparatuses includes a turning device to change a direction of a thrust with respect to the hull. The controllers control the turning devices according to a turning angle command value received through the wiring. Operating state information to be transmitted by the controllers includes a turning angle command value that the controllers receive through the wiring.

With this structure, the diagnosis device is able to collect turning angle command values that the controllers of the plurality of propulsion apparatuses receive on a common time axis through the on-board network. By comparing changes in the collected turning angle command values, an abnormality in the turning angle command values is able to be identified. This can be utilized to identify, for example, the location of an abnormality in the wiring.

In a preferred embodiment of the present invention, each of the propulsion apparatuses includes a turning device to change a direction of a thrust with respect to the hull. The turning device includes a turning angle sensor that detects a turning angle representing a direction of a thrust with respect to the hull. Operating state information to be transmitted by the controllers includes turning angle information showing a turning angle that the turning angle sensor detects.

With this structure, the diagnosis device is able to collect turning angle information of the plurality of propulsion apparatuses on a common time axis through the on-board network from the controllers of the plurality of propulsion apparatuses. By using the turning angle information collected in this way, the turning angle information of the plurality of propulsion apparatuses is able to be compared on a common time axis, so that it becomes easy to identify, for example, the location of an abnormality related to the turning device and the turning angle sensor.

In a preferred embodiment of the present invention, the controllers of the plurality of propulsion apparatuses are configured or programmed to control synchronization of the plurality of turning devices provided in the plurality of propulsion apparatuses.

Due to the synchronization control of the turning devices of the plurality of propulsion apparatuses, the turning angles of the plurality of propulsion apparatuses exhibit behavior approximate to each other. Therefore, in conventional techniques, even when an abnormality related to any of the turning devices occurs, it is not easy to identify the location of the abnormality. Therefore, by applying a preferred embodiment of the present invention, turning angle information of the plurality of propulsion apparatuses is able to be collected on a common time axis, so that by using the collected turning angle information, based on a slight temporal difference among turning angle changes, the location of an abnormality is able to be identified.

In a preferred embodiment of the present invention, each of the controllers includes a storage that stores operating state information of the respective propulsion apparatus. Operating state information to be transmitted by the controller includes the operating state information stored in the storage.

With this structure, the diagnosis device is able to collectively collect past operating state information of the plurality of propulsion apparatuses through the on-board network. Therefore, even when acquiring past operating states, it is not necessary to individually connect the diagnosis device to the individual propulsion apparatuses, so that information necessary for a diagnosis is easily collected in a short time.

A preferred embodiment of the present invention further provides a diagnosis device including a communicator that is connected to the network connector of the vessel propulsion system having the features described above, and a processing device that requests the plurality of propulsion apparatuses to transmit operating state information all at once through the communicator, and receives responses from the plurality of propulsion apparatuses through the communicator.

With this structure, the diagnosis device is able to collectively acquire operating state information from the plurality of propulsion apparatuses. Therefore, operating state information of the plurality of propulsion apparatuses is able to be collected on a common time axis. Accordingly, the vessel propulsion system is able to be diagnosed by comparing the operating state information of the plurality of propulsion apparatuses on the common time axis.

In a preferred embodiment of the present invention, the processing device executes a process to provide the operating state information of the plurality of propulsion apparatuses on a common time axis.

With this structure, the operating state information of the plurality of propulsion apparatuses is able to be compared on a common time axis, so that relative behaviors of the plurality of propulsion apparatuses are able to be checked. Accordingly, identification of the location of an abnormality, etc., is easily performed.

A preferred embodiment of the present invention provides a diagnosis method to diagnose the plurality of propulsion apparatuses by connecting a diagnosis device to the network connector of the vessel propulsion system having the features described above. The method includes requesting the plurality of propulsion apparatuses to transmit operating state information all at once, and receiving responses from the plurality of propulsion apparatuses through the on-board network, and providing the operating state information of the plurality of propulsion apparatuses on a common time axis based on the responses from the plurality of propulsion apparatuses.

With this method, operating state information is able to be collectively acquired from the plurality of propulsion apparatuses. Therefore, operating state information of the plurality of propulsion apparatuses is able to be collected on a common time axis. Accordingly, the vessel propulsion system is able to be diagnosed by comparing operating state information of the plurality of propulsion apparatuses on a common time axis.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
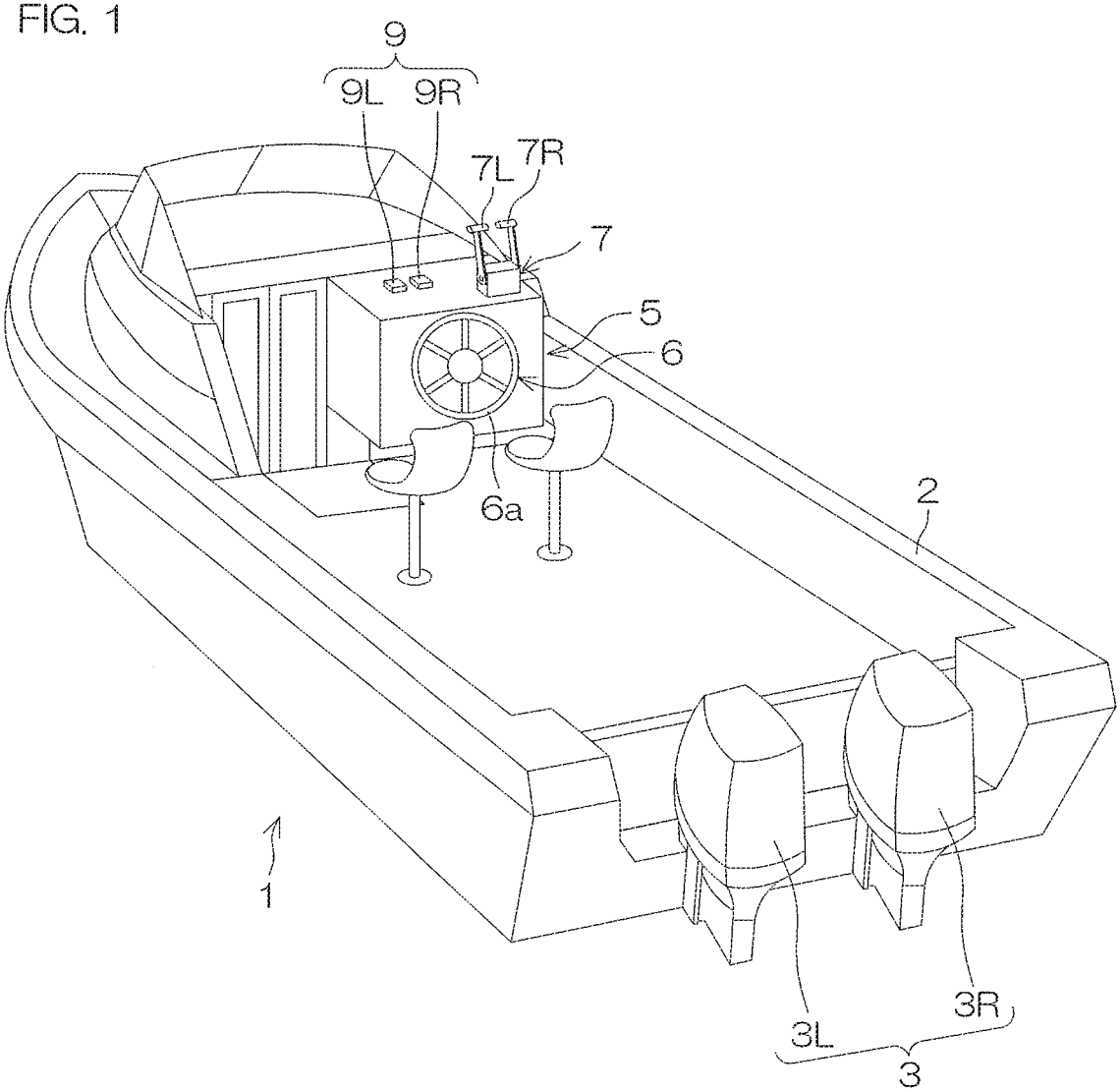
FIG. 1 is a perspective view to describe an example of a vessel equipped with a vessel propulsion system according to a preferred embodiment of the present invention.

FIG. 1 is a perspective view to describe an example of a vessel equipped with a vessel propulsion system according to a preferred embodiment of the present invention. A vessel 1 includes a hull 2 and, for example, outboard motors 3 as the propulsion apparatuses. A plurality of outboard motors 3 (for example, two in the present preferred embodiment) are provided. The outboard motors 3 are arranged in a row and attached along a stern of the hull 2 (that is, along a right-left direction of the hull 2). To distinguish the two outboard motors, the outboard motor located at the starboard is referred to as "starboard outboard motor 3R," and the outboard motor located at the portside is referred to as "portside outboard motor 3L." Each of the outboard motors 3 includes an engine (internal combustion engine) as a prime mover, and generates a thrust with a propeller 40 (refer to FIG. 2) that is rotated by a driving force of the engine.

At a front portion (stem side) of the hull 2, a vessel operation seat 5 is provided. The vessel operation seat 5 is equipped with a steering 6, a remote controller 7, and gauges 9.

The steering 6 includes a steering wheel 6*a* to be rotationally operated by a vessel operator. An operation of the steering wheel 6*a* is detected by an operation angle sensor (not shown in FIG. 1) described below.

The remote controller 7 includes two left and right levers 7L and 7R. These levers 7L and 7R are able to tilt forwardly and backwardly. Operation positions of the levers 7L and 7R are respectively detected by position sensors (not shown in FIG. 1) described below. The operation of the outboard motors 3 is controlled according to the detected operation position. By tilting the lever 7L, 7R forwardly by a predetermined amount or more from a predetermined neutral position, a shift position of the outboard motors 3 is changed to a forward position, and a thrust in a forward direction is generated by the outboard motors 3. By tilting the lever 7L, 7R backwardly by a predetermined amount or more from the neutral position, the shift position of the outboard motors 3 is changed to a backward position, and a thrust in a backward direction is generated by the outboard motors 3. When the lever 7L, 7R is at the neutral position, the shift position of the outboard motors 3 is located at the neutral position, and the outboard motors 3 do not generate a thrust. In addition, according to a tilting amount of the lever 7L, 7R, an output of the outboard motors 3, that is, a target engine rotation speed (corresponding to a target throttle opening degree) of the engine equipped in the outboard motors 3 is able to be changed.

The target engine rotation speed is kept at an idling rotation speed until a forward tilt position (forward shift-in position) corresponding to the predetermined tilt amount is reached. The target engine rotation speed is determined so that the target engine rotation speed becomes higher as the lever tilt amount increases when the lever 7L, 7R is tilted forwardly beyond the forward shift-in position. The target engine rotation speed is kept at an idling rotation speed until a backward tilt position (backward shift-in position) corresponding to the predetermined tilt amount is reached. The target engine rotation speed is determined so that the target engine rotation speed becomes higher as the lever tilt amount increases when the lever 7L, 7R is tilted backwardly beyond the backward shift-in position.

A shift position and an engine rotation speed of the starboard outboard motor 3R conforms to an operation position of the right lever 7R. A shift position and an engine rotation speed of the portside outboard motor 3L conforms to an operation position of the left lever 7L.

Two gauges 9 are provided corresponding to the two outboard motors 3, respectively. To distinguish these, a gauge corresponding to the starboard outboard motor 3R is referred to as "starboard gauge 9R," and a gauge corresponding to the portside outboard motor 3L is referred to as "portside gauge 9L." These gauges 9 display states of the corresponding outboard motors 3. More specifically, the gauge displays ON/OFF of a power supply ON/OFF, an engine rotation speed, and other information of a corresponding outboard motor 3 determined in advance.

Figure 2:
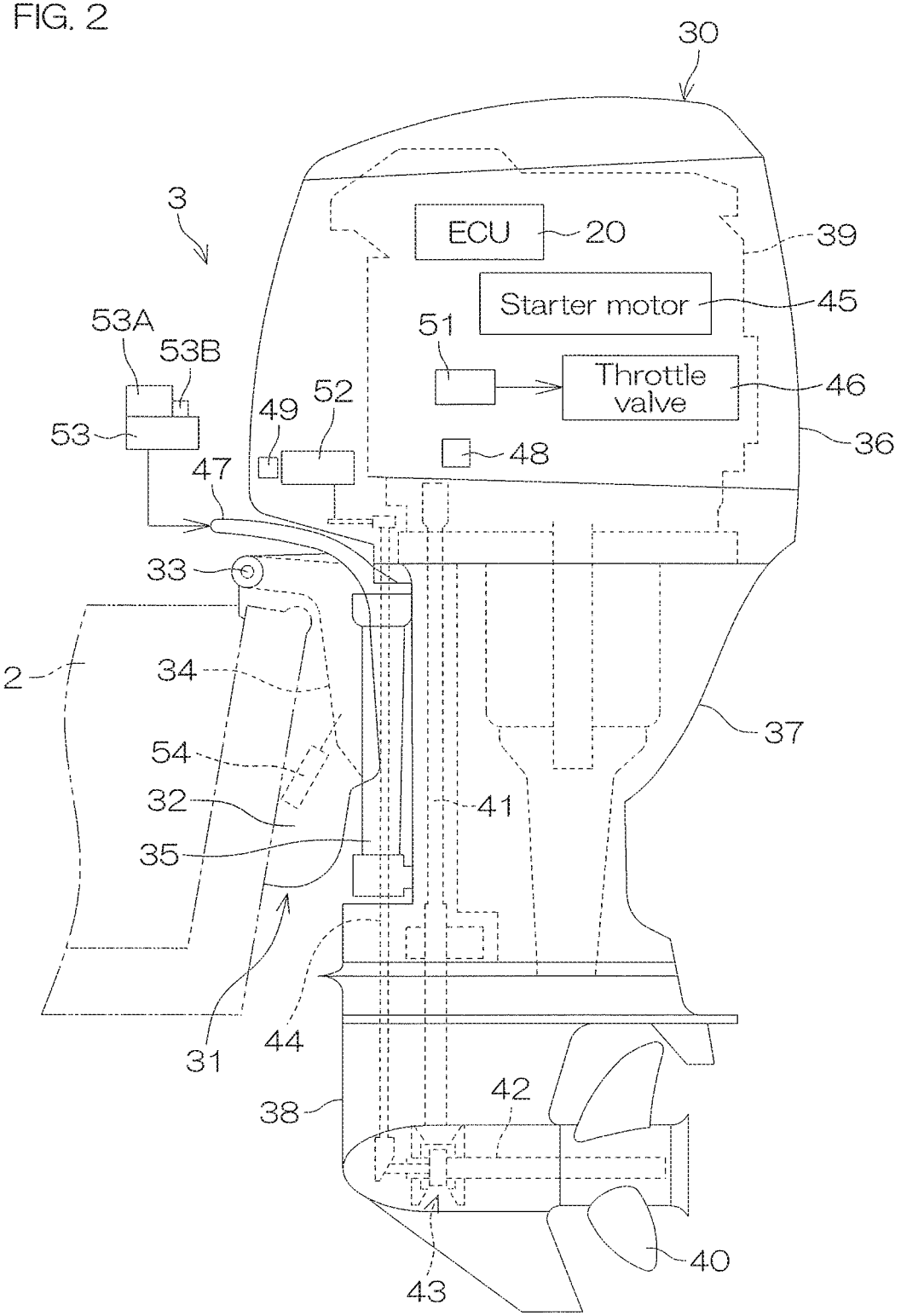
FIG. 2 is a view to describe an example of an outboard motor.

FIG. 2 is a view to describe a common example of the two outboard motors 3. The outboard motor 3 includes a propulsion unit 30 and an attachment mechanism 31 to attach the propulsion unit 30 to the hull 2. The attachment mechanism 31 includes a clamp bracket 32 to be detachably fixed to a transom of the hull 2, and a swivel bracket 34 joined to the clamp bracket 32 rotatably around a tilt shaft 33 that defines a horizontal rotational shaft. The propulsion unit 30 is attached to the swivel bracket 34 rotatably around a turning shaft 35. Thus, it is possible to change a turning angle (azimuthal angle of a direction of a thrust with respect to the center line of the hull 2) by rotating the propulsion unit 30 around the turning shaft 35. In addition, it is possible to change the trim angle of the propulsion unit 30 by rotating the swivel bracket 34 around the tilt shaft 33. The trim angle corresponds to the setting angle of the outboard motor 3 with respect to the hull 2.

A housing of the propulsion unit 30 includes an engine cover (top cowling) 36, an upper case 37, and a lower case 38. Inside the engine cover 36, an engine 39 as the prime mover is installed so that an axis of the crankshaft of the engine is set in the up-down direction. A drive shaft 41 for power transmission that is connected to a lower end of the crankshaft of the engine 39 passes through the inside of the upper case 37 in the up-down direction, and extends to the inside of the lower case 38.

A propeller 40 that defines the propulsion member is rotatably attached to the rear of a lower portion of the lower case 38. A propeller shaft 42 that is a rotational shaft of the propeller 40 extends in the horizontal direction in the lower case 38. The rotation of the drive shaft 41 is transmitted to the propeller shaft 42 through a shift mechanism 43.

The shift mechanism 43 has a plurality of shift positions (shift states) including a forward position, a backward position, and a neutral position. The neutral position is a shift position at which the shift mechanism is in a shut-off state in which it does not transmit rotation of the drive shaft 41 to the propeller shaft 42. The forward position is a shift position at which the shift mechanism is in a state in which it transmits rotation of the drive shaft 41 to the propeller shaft 42 so that the propeller shaft 42 rotates in a forward rotation direction. The backward position is a shift position at which the shift mechanism is in a state in which it transmits rotation of the drive shaft 41 to the propeller shaft 42 so that the propeller shaft 42 rotates in a backward rotation direction. The forward rotation direction is a rotation direction of the propeller 40 in which it provides a thrust in the forward direction to the hull 2. The backward rotation direction is a rotation direction of the propeller 40 in which it provides a thrust in the backward direction to the hull 2. The shift position of the shift mechanism 43 is switched by a shift rod 44. The shift rod 44 extends in the up-down direction parallel to the drive shaft 41, and is arranged such that the shift mechanism 43 is operated by rotating around an axis of the shift rod.

With respect to the engine 39, a starter motor 45 is provided to start the engine 39. The starter motor 45 is controlled by an outboard motor ECU (Electronic Control Unit) 20. The outboard motor ECU 20 is an example of the controller. A throttle actuator 51 is additionally provided to change an amount of intake air of the engine 39 by changing a throttle opening degree by actuating a throttle valve 46 of the engine 39. The throttle actuator 51 may include an electric motor, for example. The operation of the throttle actuator 51 is controlled by the outboard motor ECU 20. The engine 39 is additionally provided with an engine rotation speed sensor 48 to detect a rotation speed of the engine 39 by detecting rotation of the crankshaft.

With respect to the shift rod 44, a shift actuator 52 is provided to change the shift position of the shift mechanism 43. The shift actuator 52 includes, for example, an electric motor, and its operation is controlled by the outboard motor ECU 20. With respect to the shift actuator 52, a shift position sensor 49 to detect a shift position of the shift mechanism 43 is provided.

Further, a turning device 53 that is driven according to an operation of the steering 6 (refer to FIG. 1) is joined to a steering rod 47 which is fixed to the propulsion unit 30. The propulsion unit 30 is rotated around the turning shaft 35 by the turning device 53, and accordingly, steering is performed. The turning device 53 includes a turning actuator 53A. The turning actuator 53A is controlled by the outboard motor ECU 20. The turning actuator 53A may include an electric motor, or a hydraulic actuator. The turning device 53 further includes a turning angle sensor 53B to detect a turning angle of the propulsion unit 30. The turning angle sensor 53B may be disposed such that a position of a driver of the turning actuator 53A is detected.

A tilt/trim actuator 54 that includes, for example, a hydraulic cylinder and that is controlled by the outboard motor ECU 20 is provided between the clamp bracket 32 and the swivel bracket 34. The tilt/trim actuator 54 rotates the propulsion unit 30 around the tilt shaft 33 by rotating the swivel bracket 34 around the tilt shaft 33.

Figure 3:
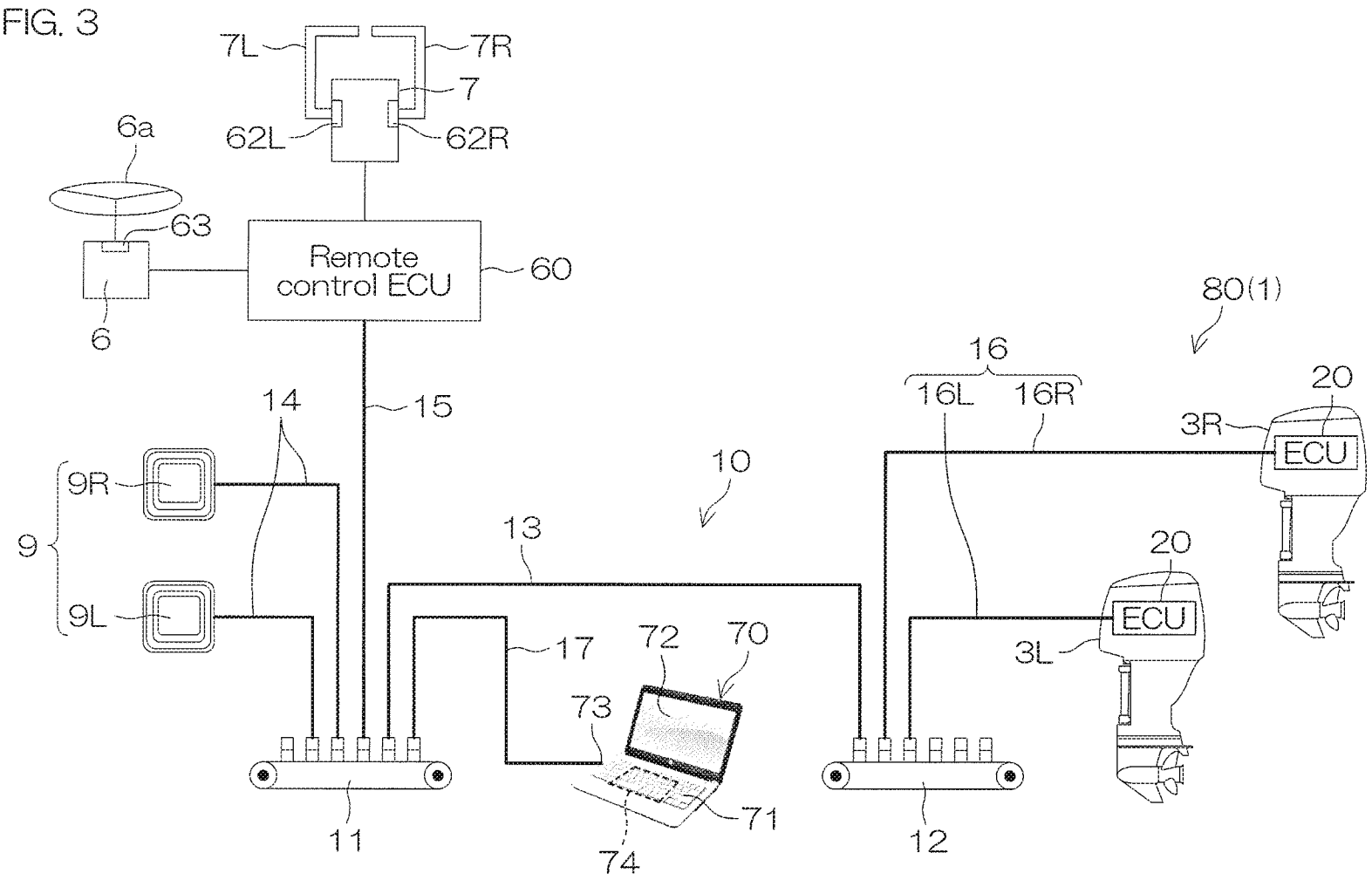
FIG. 3 is a view to describe the vessel propulsion system.

FIG. 3 is a view to describe an the vessel propulsion system 80 equipped in the vessel 1. Inside the hull 2, an on-board LAN (Local Area Network) 10 as an example of the on-board network is provided. Specifically, a remote control ECU 60, outboard motor ECUs 20 of the plurality of outboard motors 3, and the gauges 9 are connected to the on-board LAN 10, and data and control signals are communicated among them. The steering 6 and the remote controller 7 are connected to the remote control ECU 60. More specifically, the steering 6 includes an operation angle sensor 63 to detect a steering angle of the steering wheel 6*a*. An output signal of the operation angle sensor 63 is input into the remote control ECU 60. The remote controller 7 includes lever position sensors 62L and 62R to detect operation positions of the levers 7L and 7R, and output signals of these sensors are input into the remote control ECU 60.

The on-board LAN 10 includes a stem side hub 11 provided near the vessel operation seat 5, and a stern side hub 12 provided at the stern side. These are connected to each other by a LAN cable 13. To the stem side hub 11, the gauges 9 are connected through LAN cables 14, and the remote control ECU 60 is connected through a LAN cable 15. To the stern side hub 12, the outboard motor ECUs 20 of the outboard motors 3L and 3R are respectively connected through LAN cables 16L and 16R (collectively referred to as "LAN cables 16"). Each of the LAN cables 13 to 16 may be provided by bundling a power wire and a signal wire. Accordingly, the LAN cables 13 to 16 are able to send electric power through the power wires, and transmit communication signals among the devices through the signal wires.

To a free port of the stem side hub 11 or the stern side hub 12, the diagnosis device 70 is connected. In other words, at least one of the hubs 11 and 12 is an example of the network connector to connect the diagnosis device 70 to the on-board LAN 10. The diagnosis device 70 may include, for example, a personal computer, and includes an input 71, a display 72, a communication port 73, and a processing device 74. The input 71 may include a keyboard and/or a pointing device. The display 72 may be a two-dimensional display such as a liquid crystal display. The communication port 73 is a LAN port connectable to the hub 11, 12 through a LAN cable 17, and is an example of the communicator. The communication port 73 may be connectable to the hub 11, 12 through an appropriate adapter if necessary. The processing device 74 executes processes to communicate with the outside through the communication port 73, and various arithmetic processes.

Figure 4:
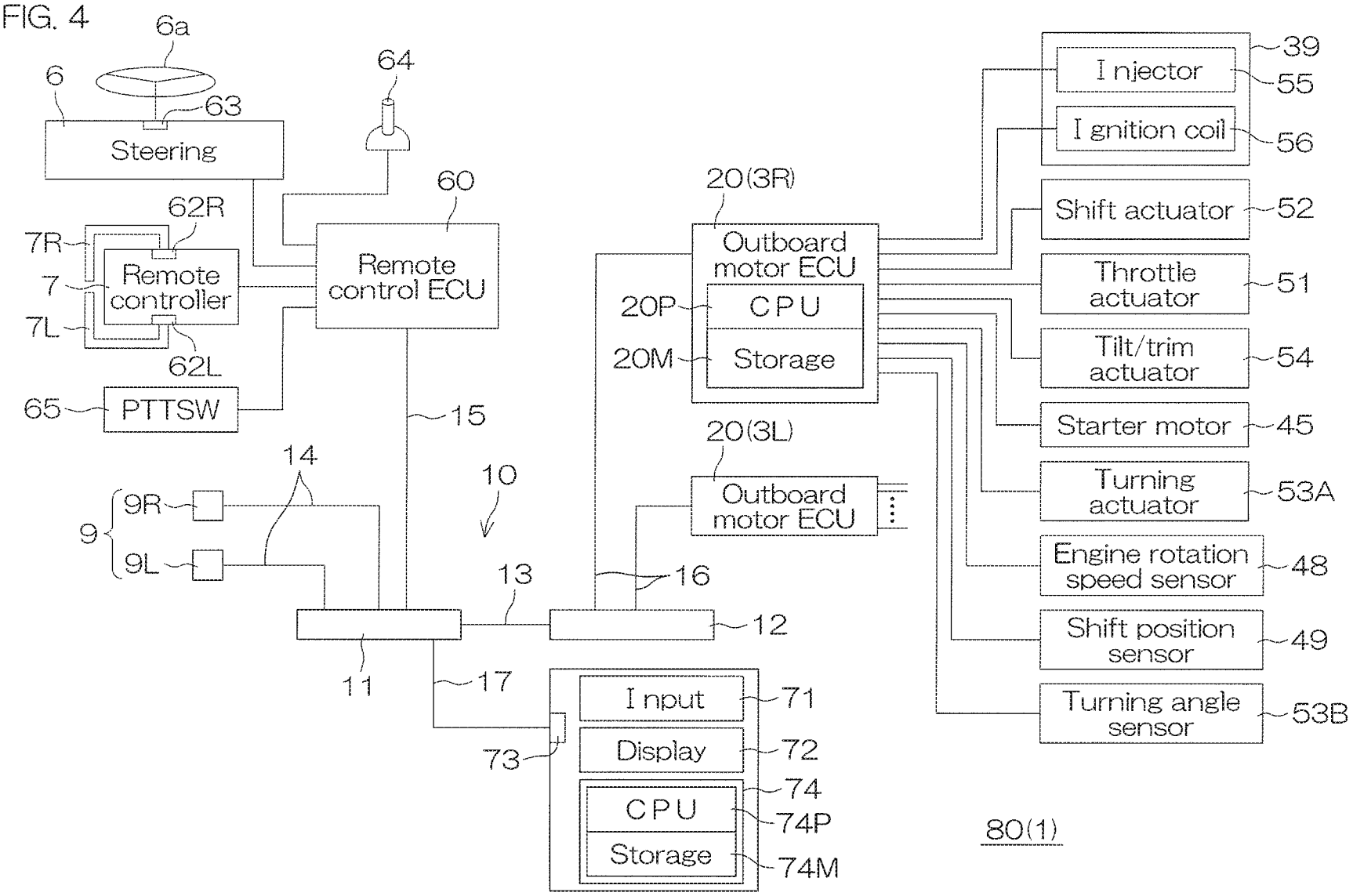
FIG. 4 is a block diagram to describe an electrical configuration of the vessel propulsion system.

FIG. 4 is a block diagram to describe an electrical configuration of the vessel propulsion system 80 equipped in the vessel 1. The remote controller 7 includes lever position sensors 62L and 62R to detect operation positions of the left and right remote control levers 7L and 7R. Output signals of the lever position sensors 62L and 62R are input into the remote control ECU 60. The steering 6 is connected to the remote control ECU 60. More specifically, an output signal of the operation angle sensor 63 that detects an operation angle of the steering wheel 6*a* is input into the remote control ECU 60. Other operation devices such as a joystick 64 and a power tilt/trim switch (PTTSW) 65, etc., may further be connected to the remote control ECU 60. The remote control ECU 60 incorporates a microcomputer, and generates control commands to control the outboard motors 3R and 3L according to input signals.

On the other hand, each of the outboard motors 3R and 3L includes an outboard motor ECU 20. To the outboard motor ECU 20, the engine 39 (more specifically, an injector 55 and an ignition coil 56), the shift actuator 52, the throttle actuator 51, the tilt/trim actuator 54, the starter motor 45, and the turning actuator 53A are connected as control targets. These control targets may be referred to as "actuators," hereinafter.

Further, signals from sensors including the engine rotation speed sensor 48, the shift position sensor 49, and the turning angle sensor 53B, etc., are input into the outboard motor ECU 20.

FIG. 4 illustrates only actuators (control targets) to be controlled by the outboard motor ECU 20 corresponding to the starboard outboard motor 3R, and sensors. As a matter of course, similar actuators equipped in the portside outboard motor 3L are controlled by a corresponding outboard motor ECU 20. Signals of similar sensors equipped in the portside outboard motor 3L are input into the outboard motor ECU 20 of the portside outboard motor 3L.

The outboard motor ECU 20 incorporates a microcomputer, and controls the actuators according to control commands provided from the remote control ECU 60. More specifically, the outboard motor ECU 20 includes a processor 20P and a storage 20M, e.g., memory storage. The processor 20P controls the actuators by executing various arithmetic processes and control processes according to programs stored in the storage 20M. The processor 20P stores values detected by the sensors equipped in the outboard motor 3 in the storage 20M, and when an abnormality occurs in the outboard motor 3, stores abnormality record information showing the content and an occurrence time, etc., of the abnormality in the storage 20M.

The remote control ECU 60 and the outboard motor ECUs 20 of the outboard motors 3R and 3L communicate with each other through the above-described on-board LAN 10 provided in the vessel 1.

The remote control ECU 60 designates an outboard motor ECU 20 as a communication destination and outputs a control command to the designated outboard motor ECU 20. The designated outboard motor ECU 20 receives this control command, and controls the actuators according to the control command. However, it is also possible that the outboard motor ECU 20 takes-in a control command addressed to and sent to the outboard motor ECU 20 of the other outboard motor and uses this control command to control the actuators.

The control commands include an output command value to command an output of the engine 39 of the outboard motor 3, a shift command value to command a shift position (forward, backward, neutral) of the outboard motor 3, and a turning angle command value to command a turning angle of the outboard motor 3. The output command value may be a target value of the rotation speed of the engine 39 of the outboard motor 3. According to this output command value, the outboard motor ECU 20 controls the throttle actuator 51. The shift command value is a command value related to a shift position of the shift mechanism 43. According to this shift command value, the outboard motor ECU 20 controls the shift actuator 52. The turning angle command value is a target value of an azimuthal angle of the outboard motor 3 with respect to the hull 2. Normally, a turning angle command value corresponding to an operation angle of the steering wheel 6*a* is generated. According to this turning angle command value, the outboard motor ECU 20 controls the turning actuator 53A. In the present preferred embodiment, the remote control ECU 60 is an example of the turning angle command value generator.

In the present preferred embodiment, each of the outboard motor ECUs 20 is configured or programmed to execute output synchronization control to synchronize or syntonize outputs of the plurality of outboard motors 3, and turning synchronization control to synchronize or syntonize turning of the plurality of outboard motors 3. The output synchronization control includes, for example, control of the starboard outboard motor 3R in synchronization with an output of the portside outboard motor 3L by the outboard motor ECU 20 of the starboard outboard motor 3R (specifically, engine rotation speed). The turning synchronization control includes, for example, control of a turning response of a corresponding outboard motor 3 by each outboard motor ECU 20 in synchronization with an outboard motor 3 whose turning response is the slowest among the plurality of outboard motors 3. Due to the output synchronization control, thrusts to be generated by the plurality of outboard motors 3 are matched with each other so that excellent vessel operation performance is realized. In addition, due to the turning synchronization control, the plurality of outboard motors 3 turn in synchronization with each other so that outboard motors 3 adjacent to each other are prevented from interfering with each other.

The control commands may include a tilt command and a trim command in addition to the above-described commands. The tilt command and the trim command are generated in response to an operation of the power tilt/trim switch 65. The tilt command is a command to lift the propeller 40 of the outboard motor 3 over a water surface or submerge the propeller in water. The trim command is a command to change a depression angle/elevation angle of the outboard motor 3 with respect to the hull 2. The outboard motor ECU 20 controls the tilt/trim actuator 54 according to a tilt command and a trim command.

As described above, the gauges 9 are connected to the on-board LAN 10. The diagnosis device 70 is able to be connected to the on-board LAN 10. The processing device 74 of the diagnosis device 70 includes a processor 74P (CPU) and a storage 74M, e.g., memory storage, and the processor 74P executes processes to communicate with the outside through the communication port 73, and various arithmetic processes according to programs stored in the storage 74M.

Figure 5:
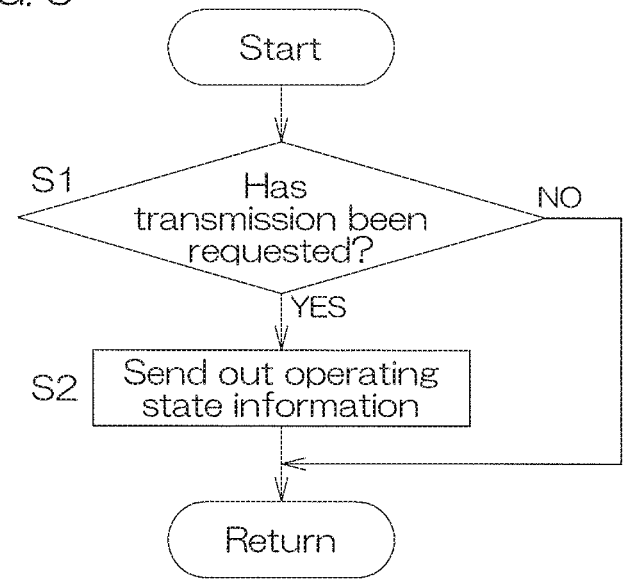
FIG. 5 is a flowchart to describe operation of an outboard motor ECU with respect to a request from a diagnosis device.

FIG. 5 is a flowchart to describe a response operation of the outboard motor ECU 20 to a request from the diagnosis device 70, and shows a process to be repeated with a predetermined control period. The processor 20P of the outboard motor ECU 20 checks whether a transmission request to request transmission of operating state information has been issued from the diagnosis device 70 (Step S1). When a transmission request is issued, the processor 20P sends out operating state information addressed to the diagnosis device 70 and responds to this transmission request via the on-board LAN 10 (Step S2). The operating state information to be sent out may be information read out from the storage 20M, or may be information acquired from the sensors. Information to be read out from the storage 20M may include information showing past detected values of sensors, and may include abnormality record information.

Figure 6:
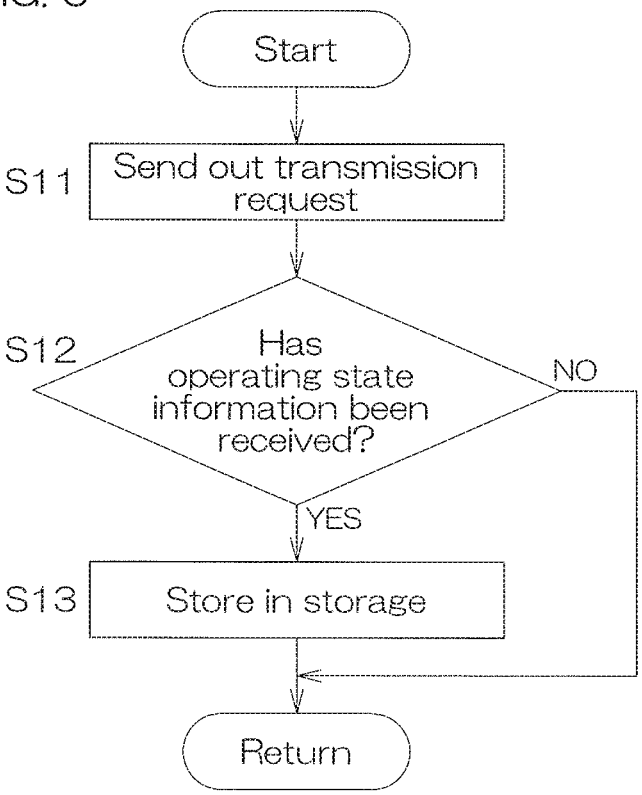
FIG. 6 is a flowchart to describe an information acquiring operation of the diagnosis device.

FIG. 6 is a flowchart to describe an information acquiring operation to be repeatedly executed with a predetermined period by the diagnosis device 70 connected to the on-board LAN 10. The processor 74P of the diagnosis device 70 generates a transmission request (batch transmission request) to request all of the outboard motor ECUs 20 connected to the on-board LAN 10 to transmit operating state information (Step S11). In response to this request, the outboard motor ECUs 20 respectively transmit operating state information to the on-board LAN 10, and when the communication port 73 receives this information (Step S12), the processor 74P stores the received operating state information in the storage 74M (Step S13).

The processor 74P of the diagnosis device 70 repeatedly sends out a batch transmission request in each control period. Accordingly, on a common time axis, operating state information of the plurality of outboard motors 3 is able to be acquired a plurality of times in chronological order.

A normal failure diagnosis is made by a diagnosis operator while the vessel 1 is not in use, such as during anchorage of the vessel 1. The diagnosis operator connects the diagnosis device 70 to the on-board LAN 10, and takes operation record information stored in the storages 20M of the outboard motor ECUs 20 into the diagnosis device 70. When an abnormality is found in the operation record information, the diagnosis operator takes the necessary measures.

On the other hand, collection of operating state information to diagnose a matter to be checked by comparing operating state information of the plurality of outboard motors 3 on a common time axis is performed in a state in which the plurality of outboard motors 3 are operated. Such a diagnosis may be made in a state in which the vessel 1 is anchored, or in a state in which the vessel 1 is under sail. In any case, a diagnosis is made in a state in which the diagnosis device 70 is connected to the on-board LAN 10. Depending on the circumstances, it is also possible that, in a state in which the diagnosis device 70 is connected to the on-board LAN 10, the vessel 1 is operated by a user, and the diagnosis device 70 collects operating state information in real time under normal use conditions. Collected operating state information is stored in the storage 74M.

Examples of operating state information to be collected in this way in real time are engine rotation speed information, turning angle command value information, and actual turning angle information, for example. As a matter of course, other information may be included, and in particular, detected values of various sensors and various command values that the outboard motor ECUs 20 receive may be included in the operating state information as collection targets.

Figure 7:
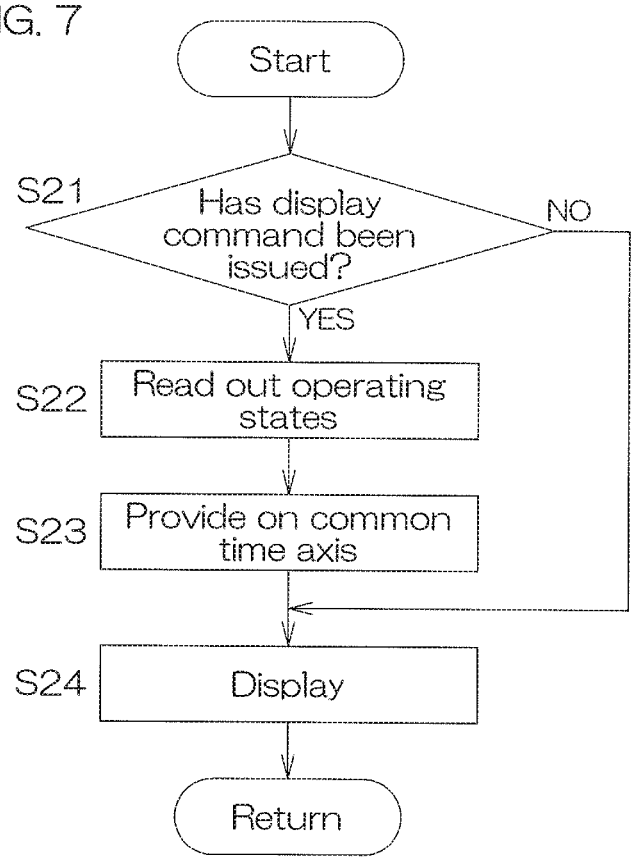
FIG. 7 is a flowchart to describe an example of a process to be applied to operating state information by the diagnosis device.
Figure 9A:
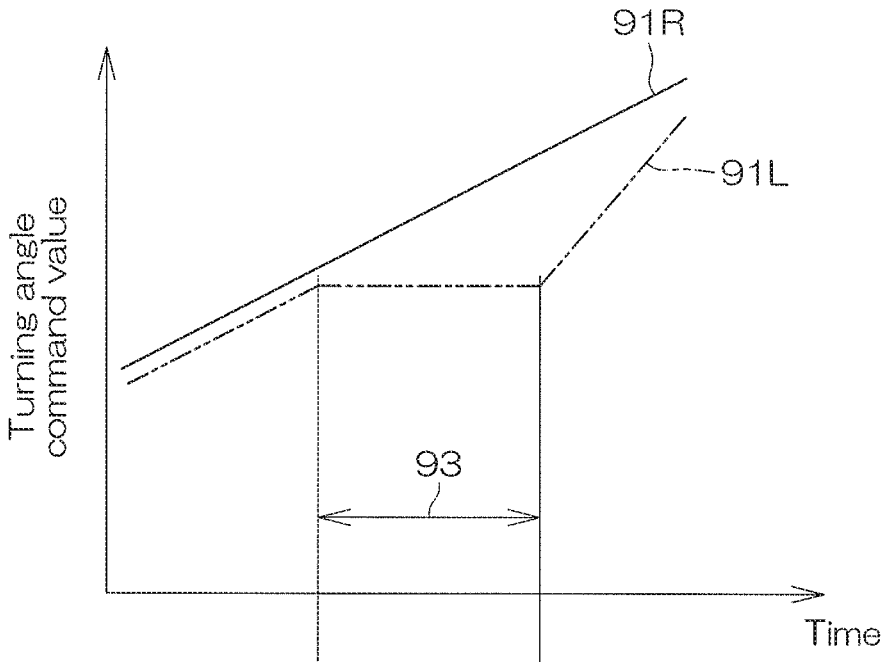
FIGS. 9A and 9B are diagrams showing examples of temporal changes in turning angle command values that the plurality of outboard motors receive.
Figure 10:
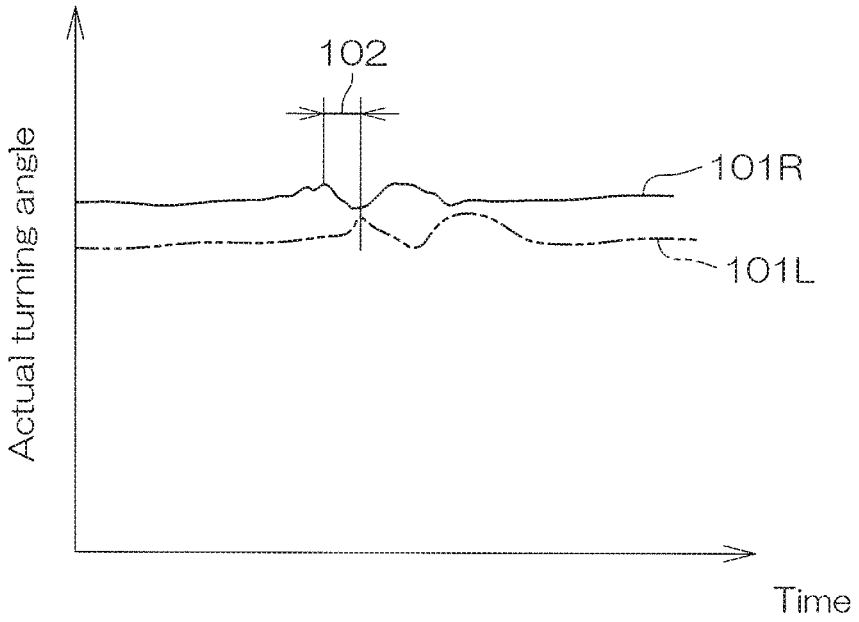
FIG. 10 is a diagram showing examples of temporal changes in actual turning angles of the plurality of outboard motors on a common time axis.

FIG. 7 is a flowchart to describe an example of a process to be applied to operating state information by the diagnosis device 70. In a state in which collected operating state information is stored in the storage 74M, a diagnosis operator inputs a command to make the display 72 display the operating state information from the input 71 (Step S21). Accordingly, the processor 74P of the processing device 74 reads out operating state information related to the plurality of outboard motors 3 from the storage 74M (Step S22), and provides the operating state information on a common time axis (Step S23). The processor 74P further executes a display control to graphically display the information on the screen of the display (Step S24). Examples of graphic display are shown in FIG. 8, FIG. 9A, and FIG. 10 described next.

Figure 8:
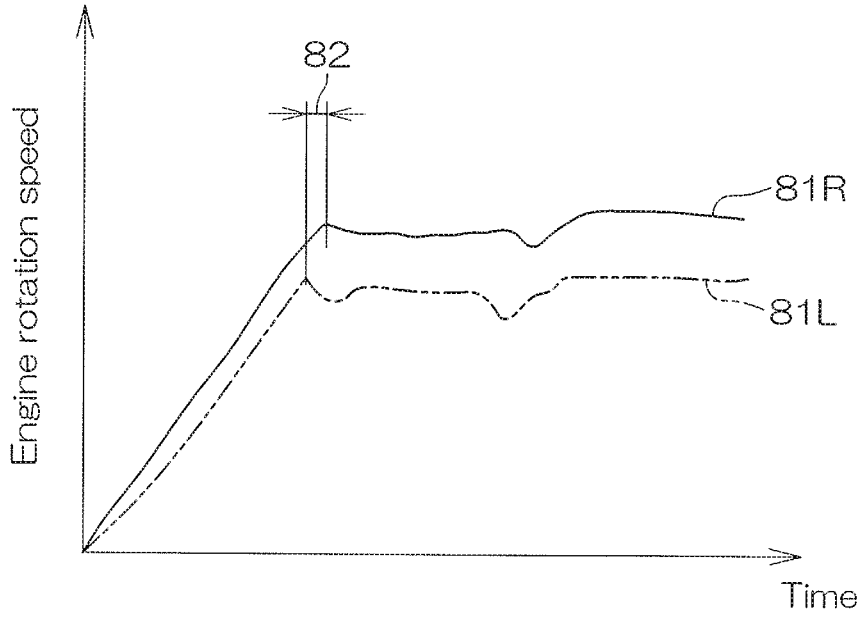
FIG. 8 is a diagram showing examples of changes in engine rotation speeds of a plurality of outboard motors on a common time axis.

FIG. 8 is a diagram to describe an example of a case in which an abnormality occurs in one of the plurality of outboard motors 3, and shows changes in engine rotation speeds of the plurality of outboard motors 3 on a common time axis. More specifically, changes in engine rotation speed of the portside outboard motor 3L are shown by the curve 81L, and changes in engine rotation speed of the starboard outboard motor 3R are shown by the curve 81R. For example, when a failure such as partial binding of the bearing or partial solidification of oil occurs in the portside outboard motor 3L, even if a vessel operator performs an accelerating operation to open the throttle, revving-up (acceleration of engine rotation speed) of the portside outboard motor 3L deteriorates. Moreover, due to the output synchronization control, the engine rotation speed of the starboard outboard motor 3R changes in the same way as the engine rotation speed of the portside outboard motor 3L. Therefore, a user feels that the acceleration performance has deteriorated, and complains about the malfunction.

On the other hand, even when the output synchronization control is performed, outputs of all of the outboard motors 3 do not necessarily perfectly match each other. For example, when a full throttle output command is provided from the remote control ECU 60, the engines 39 of all of the outboard motors 3 are controlled to a full-throttle state. At this time, if the rise of the engine rotation speed of the portside outboard motor 3L slows down, the engine rotation speeds of the other outboard motor 3R follows the rise a short time 82 later. This delay by the short time 82 becomes apparent by showing temporal changes in the engine rotation speeds of the plurality of outboard motors 3 on a common time axis. It is difficult to recognize such a delay by the short time 82 through the five physical senses of a human, so that it is difficult to identify an outboard motor 3 (the portside outboard motor 3L in the example described above) that causes the malfunction.

The diagnosis device 70 of the present preferred embodiment collectively acquires operating state information (including engine rotation speeds) of the plurality of outboard motors 3 from the plurality of outboard motor ECUs 20 through the on-board LAN 10, so that the acquired information is able to be provided on a common time axis. In this way, by displaying (graphically displaying as shown in, for example, FIG. 8) the operating state information on a common time axis by the display 72, a diagnosis operator is able to easily identify an outboard motor 3 that has failed.

Figure 9B:
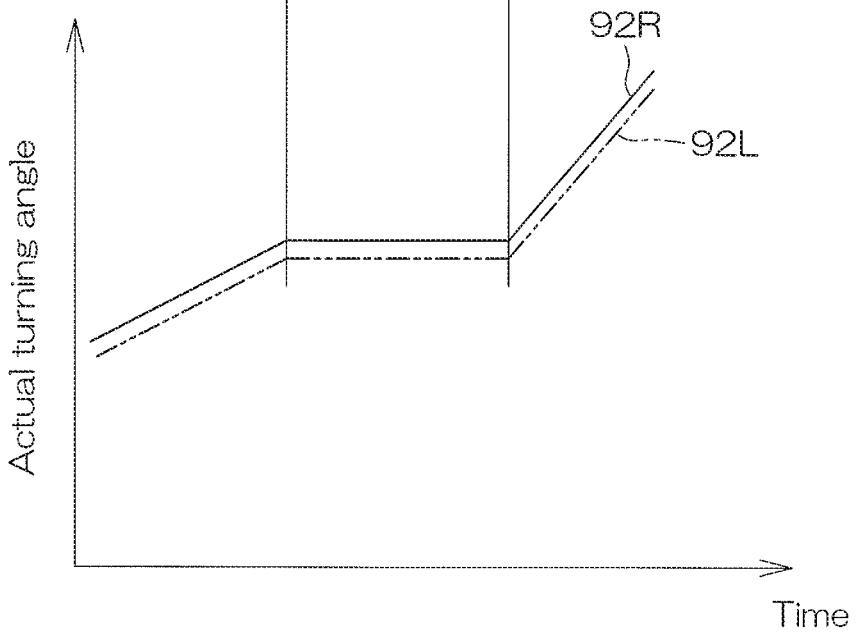

FIGS. 9A and 9B are diagrams to describe an example of a case in which an abnormality occurs in any of turning angle command values that the plurality of outboard motor ECUs 20 respectively receive from the remote control ECU 60. In FIG. 9A, temporal changes in turning angle command values that the plurality of outboard motor ECUs 20 receive are shown on a common time axis. FIG. 9B shows changes in actual turning angles of the respective outboard motors 3.

More specifically, temporal changes in turning angle command values received by the outboard motor ECUs 20 of the portside outboard motor 3L and the starboard outboard motor 3R are respectively shown by the curves 91L and 91R in FIG. 9A. Temporal changes in actual turning angles of the portside outboard motor 3L and the starboard outboard motor 3R are shown by the curves 92L and 92R in FIG. 9B. The actual turning angle is a turning angle that the turning angle sensor 53B detects, and is an actual turning angle of the outboard motor 3.

For example, a temporary breakage of a signal wire (in the present preferred embodiment, the LAN cable 16, etc.) that transmits a turning angle command value from the remote control ECU 60 to the outboard motor ECU 20 causes an abnormality of the turning angle command value. In the example shown in FIGS. 9A and 9B, an abnormality occurs in the turning angle command value that the outboard motor ECU 20 of the portside outboard motor 3L receives. More specifically, in a period 93, although the turning angle command value that the outboard motor ECU 20 of the starboard outboard motor 3R receives changes, the turning angle command value that the outboard motor ECU 20 of the portside outboard motor 3L receives does not change.

As described above, the outboard motor ECUs 20 of the respective outboard motors 3 perform the turning synchronization control. For example, each of the outboard motor ECUs 20 acquires information on an actual turning angle from the other outboard motor 3. Each of the outboard motor ECUs 20 feedback-controls a corresponding turning device 53 based on a turning angle command value that this outboard motor ECU 20 receives. On the other hand, when the change of the actual turning angle of the other outboard motor 3 does not follow the turning angle command value, the outboard motor ECU 20 controls a corresponding turning device 53 so that the actual turning angle matches an actual turning angle of an outboard motor 3 whose turning response is the slowest.

Therefore, in the example shown in FIGS. 9A and 9B, as a result, turning angles of all of the outboard motors 3 are controlled so as to conform to the turning angle command value that the outboard motor ECU 20 of the portside outboard motor 3L receives. Therefore, in the period 93, actual turning angles of all outboard motors 3 do not substantially change, and after the period 93 elapses, the actual turning angles start to change. A period in which the actual turning angle does not change although the turning angle command value continuously changes occurs, so that a vessel operator feels uncomfortable. However, due to the turning synchronization control, which of the outboard motors 3 the failure is related to is not identified.

The diagnosis device 70 of the present preferred embodiment collectively acquires operating state information from the plurality of outboard motor ECUs 20 through the on-board LAN 10, so that turning angle command values that the plurality of outboard motor ECUs 20 receive are able to be provided on a common time axis. By graphically displaying these on the display 72 of the diagnosis device 70 (for example, the display as shown in FIG. 9A), a diagnosis operator is able to easily identify which outboard motor ECU 20 receives a turning angle command value in which an abnormality has occurred.

FIG. 10 is a diagram to describe an example of a case in which an abnormality has occurred in any of the plurality of turning devices 53 that the plurality of outboard motors 3 respectively include, and shows temporal changes in actual turning angles of the plurality of outboard motors 3 (output signals of the turning angle sensors 53B) on a common time axis. More specifically, temporal changes in actual turning angles of the portside outboard motor 3L and the starboard outboard motor 3R are respectively shown by the curves 101L and 101R.

For example, if a failure occurs inside the actuator (for example, an electric motor) of the turning device 53 of the starboard outboard motor 3R, although a vessel operator performs a steering operation by rotating the steering wheel 6*a*, the turning response of the starboard outboard motor 3R deteriorates. Moreover, due to the turning synchronization control, turning of the other outboard motor 3L also deteriorates in response in the same way. Therefore, the user feels that the turning response has deteriorated, and complains about the malfunction. In addition, as shown in the example in FIG. 10, there is a case in which an abnormality occurs in wiring of the turning angle sensor 53B of the starboard outboard motor 3R, and noise is mixed in an actual turning angle. In this case, not only is the turning control of the starboard outboard motor 3R affected, but also the turning control of the other outboard motor 3L has a similar effect, and actual turning angles exhibit behavior containing a noise component.

On the other hand, even when the turning synchronization control is performed, changes in actual turning angles of all of the outboard motors 3 do not necessarily perfectly match each other. In other words, when the actual turning angle of the starboard outboard motor 3R exhibits a behavior different from that of the actual turning angle of the other outboard motor 3L, a short time 102 later the actual turning angle of the other outboard motor 3L follows the behavior. Such a delay by the short time 102 becomes apparent by providing and showing the actual turning angles of the plurality of outboard motors 3 on a common time axis. It is difficult to confirm this delay by the short time 102 through the five physical senses of a human, so that it is difficult to identify an outboard motor 3 that causes the malfunction.

The diagnosis device 70 of the present preferred embodiment collectively acquires operating state information (including actual turning angles) of the plurality of outboard motors 3 from the plurality of outboard motor ECUs 20 through the on-board LAN 10, so that the acquired information is able to be provided on a common time axis. In this way, by displaying (for example, graphically displaying as shown in FIG. 10) operating state information on a common time axis by the display 72 of the diagnosis device 70, a diagnosis operator is able to easily identify an outboard motor 3 that has failed.

As described above, according to the present preferred embodiment, the diagnosis device 70 is connected to the on-board LAN 10 through the hub 11, 12. Therefore, the diagnosis device 70 communicates with the outboard motor ECUs 20 of the plurality of outboard motors 3 through the on-board LAN 10. The outboard motor ECUs 20 of the respective outboard motors 3 transmit operating state information of the outboard motors 3 to the diagnosis device 70. Therefore, the diagnosis device 70 acquires operating state information of the plurality of outboard motors 3 on a common time axis. Accordingly, the diagnosis device diagnoses the plurality of outboard motors 3 by comparing the operating state information of the plurality of outboard motors 3 on the common time axis.

More specifically, the diagnosis device 70 acquires rotation speed information representing engine rotation speeds (prime mover rotation speeds) on a common time axis from the plurality of outboard motors 3. Accordingly, the diagnosis device diagnoses the plurality of outboard motors 3 by comparing the engine rotation speeds of the plurality of outboard motors 3 on the common time axis.

In particular, in the present preferred embodiment, outputs (rotation speeds) of the engines 39 of the plurality of outboard motors 3 are controlled in synchronization. Therefore, the engine rotation speeds of the plurality of outboard motors 3 temporally change in the same way, so that even when there is an outboard motor 3 that exhibits an engine rotation speed behavior different from the other, it is difficult to identify a causal outboard motor 3 through the five physical senses of a user or diagnosis operator. However, by acquiring engine rotation speeds of the plurality of outboard motors 3 on a common time axis through the on-board LAN 10 and comparing these by the diagnosis device 70, an outboard motor 3 having the different engine rotation speed behavior is easily identified.

According to the present preferred embodiment, the diagnosis device 70 collects turning angle command values that the outboard motor ECUs 20 of the plurality of outboard motors 3 receive from the remote control ECU 60 on a common time axis. By comparing changes in the collected turning angle command values, an abnormality in the turning angle command value is able to be identified. This is utilized for identification of the location of an abnormality in the wiring (in the present preferred embodiment, a LAN cable).

According to the present preferred embodiment, the diagnosis device 70 collects actual turning angles (turning angle information) of the plurality of outboard motors 3 on a common time axis from the outboard motor ECUs 20 of the plurality of outboard motor 3 through the on-board LAN 10. By using the actual turning angles collected in this way, the actual turning angles of the plurality of outboard motors 3 are compared on a common time axis, so that, for example, the location of an abnormality related to the turning device 53 or the turning angle sensor 53B is easily identified.

In particular, in the present preferred embodiment, the turning devices 53 of the plurality of outboard motors 3 are controlled in synchronization, so that the actual turning angles of the plurality of outboard motors 3 exhibit behavior approximate to each other. Therefore, it is not easy to identify the location of an abnormality through the five physical senses of a user or diagnosis operator. However, by collecting actual turning angles of the plurality of outboard motors 3 on a common time axis with the diagnosis device 70, the location of an abnormality is identified based on a slight temporal difference between the actual turning angle changes.

In the present preferred embodiment, the diagnosis device 70 collectively collects past operating state information of the plurality of outboard motors 3 through the on-board LAN 10. Therefore, even when acquiring past operating states, it is not necessary to individually connect the diagnosis device 70 to the individual outboard motor ECUs 20, so that information necessary for a diagnosis is easily collected in a short time.

By operating the vessel 1 in a state in which the diagnosis device 70 is connected to the on-board LAN 10, the diagnosis device 70 acquires operating state information of the outboard motors 3 on a common time axis over a long period of time. The operating state information acquired in this way is stored in the storage 74M. At a later date, a diagnosis operator is able to analyze the operating state information stored in the storage 74M of the diagnosis device 70. At this time, the processing device 74 of the diagnosis device 70 provides the operating state information of the plurality of outboard motors 3 on a common time axis, and displays (for example, graphically displays) the information on the display 72. Accordingly, the operating state information of the plurality of outboard motors 3 is easily compared on the common time axis, so that the vessel propulsion system 80 including the plurality of outboard motors 3 is quickly diagnosed. In other words, since operating state information of the plurality of outboard motors 3 is compared on a common time axis, relative behaviors of the plurality of outboard motors 3 are able to be checked. Accordingly, identification of the location of an abnormality, etc., is easily and quickly performed.

Although preferred embodiments of the present invention have been described above, the present invention can also be carried out in other various modes. For example, in the preferred embodiments described above, outboard motors are used as an example of the propulsion apparatuses. However, the present invention is also applicable in the same manner to other types of propulsion apparatuses, for example, water-jet propulsion apparatuses, etc. In addition, in the preferred embodiments described above, an engine is used as an example of a prime mover. However, the present invention is also applicable to a vessel propulsion system equipped with propulsion apparatuses including other types of prime movers, for example, electric motors. As a matter of course, the number of propulsion apparatuses is not limited to two, and three or more propulsion apparatuses may be provided.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A vessel propulsion system comprising:

an on-board network;

a plurality of propulsion apparatuses provided on a hull and connected to the on-board network; and a network connector to connect a diagnosis device to the on-board network; wherein each of the plurality of propulsion apparatuses includes a controller configured or programmed to transmit operating state information indicating an operating state of the propulsion apparatus to the diagnosis device via the network connector;

the diagnosis device sends a request to the plurality of propulsion apparatuses to transmit the operating state information all at once through the network connector; and the controllers of all the plurality of propulsion apparatuses respond to the request and transmit the operating state information through the network connector to the diagnosis device.

2. The vessel propulsion system according to claim 1, wherein each of the plurality of propulsion apparatuses includes a prime mover and a propulsion generator that generates a thrust by being driven by the prime mover; and the operating state information to be transmitted by the controller of each respective propulsion apparatus includes rotation speed information showing a rotation speed of the prime mover.

3. The vessel propulsion system according to claim 2, wherein the controllers of the plurality of propulsion apparatuses are configured or programmed to synchronize the prime movers in the plurality of propulsion apparatuses.

4. The vessel propulsion system according to claim 1, wherein each of the plurality of propulsion apparatuses includes a turning device to change a direction of a thrust of a respective propulsion apparatus with respect to the hull;

the turning device includes a turning angle sensor that detects a turning angle representing a direction of the thrust with respect to the hull; and the operating state information to be transmitted by the controller of each respective propulsion apparatus includes turning angle information showing a turning angle that the turning angle sensor detects.

5. The vessel propulsion system according to claim 1, wherein the controller includes a storage that stores the operating state information; and the operating state information to be transmitted by the controller includes the operating state information stored in the storage.

6. A vessel propulsion system comprising:

an on-board network;

a plurality of propulsion apparatuses provided on a hull and connected to the on-board network; and a network connector to connect a diagnosis device to the on-board network; wherein each of the plurality of propulsion apparatuses includes a controller configured or programmed to transmit operating state information indicating an operating state of the propulsion apparatus to the diagnosis device via the network connector;

the vessel propulsion system further comprises a turning angle command value generator that generates turning angle command values for the plurality of propulsion apparatuses, and wiring that transmits the turning angle command values generated by the turning angle command value generator to the controllers of the plurality of propulsion apparatuses; wherein each of the plurality of propulsion apparatuses includes a turning device to change a direction of a thrust of a respective propulsion apparatus with respect to the hull;

the controller of each respective propulsion apparatus is configured or programmed to control the turning device according to a turning angle command value received through the wiring; and the operating state information to be transmitted by the controller of each respective propulsion apparatus includes a turning angle command value that the controller receives through the wiring.

7. The vessel propulsion system according to claim 6, wherein the controllers of the plurality of propulsion apparatus are configured or programmed to synchronize the plurality of turning devices provided in the plurality of propulsion apparatuses.

8. A diagnosis device comprising:

a communicator connected to the network connector of the vessel propulsion system according to claim 1; and a processing device to request the plurality of propulsion apparatuses to transmit operating state information all at once through the communicator, and to receive responses from the plurality of propulsion apparatuses through the communicator.

9. The diagnosis device according to claim 8, wherein the processing device provides the operating state information of the plurality of propulsion apparatuses on a common time axis.

10. A method of diagnosing a plurality of propulsion apparatuses by connecting a diagnosis device to the network connector of the vessel propulsion system according to claim 1, the method comprising:

requesting the plurality of propulsion apparatuses to transmit operating state information all at once, and receiving responses from the plurality of propulsion apparatuses through an on-board network; and providing operating state information of the plurality of propulsion apparatuses on a common time axis based on the responses from the plurality of propulsion apparatuses.

* * * * *